US009943866B2

(12) United States Patent
Yu

(10) Patent No.: US 9,943,866 B2
(45) Date of Patent: Apr. 17, 2018

(54) COATING DEVICE

(71) Applicant: Shenzhen China Star Optoelectronics Technology Co., Ltd., Shenzhen, Guangdong (CN)

(72) Inventor: Wei Yu, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 66 days.

(21) Appl. No.: 14/893,175

(22) PCT Filed: Oct. 23, 2015

(86) PCT No.: PCT/CN2015/092719

§ 371 (c)(1),
(2) Date: Nov. 23, 2015

(87) PCT Pub. No.: WO2017/024676

PCT Pub. Date: Feb. 16, 2017

(65) Prior Publication Data

US 2017/0165690 A1 Jun. 15, 2017

(30) Foreign Application Priority Data

Aug. 13, 2015 (CN) ..... 2015 1 0494358

(51) Int. Cl.
*B05B 7/16* (2006.01)
*B05B 9/00* (2006.01)
*B05B 9/03* (2006.01)

(52) U.S. Cl.
CPC ..... *B05B 9/002* (2013.01); *B05B 7/16* (2013.01); *B05B 9/03* (2013.01)

(58) Field of Classification Search
USPC ..... 118/302, 666, 667, 300
See application file for complete search history.

(56) References Cited

U.S. PATENT DOCUMENTS 2,922,869 A * 1/1960 Ducati ..... B05B 7/226 118/302
8,702,716 B1 * 4/2014 Stein ..... A61F 2/44 606/94

FOREIGN PATENT DOCUMENTS

| | | | |
|---|---|---|---|
| CN | 200988021 | Y | 12/2007 |
| CN | 200998702 | Y | 1/2008 |
| CN | 201760385 | U | 3/2011 |
| CN | 103111408 | A | 5/2013 |
| CN | 203355980 | A | 12/2013 |
| CN | 204261842 | U | 4/2015 |
| CN | 204276283 | U | 4/2015 |

(Continued)

OTHER PUBLICATIONS

English Translation JP2013-056317A, Mar. 2013.*

*Primary Examiner* — Yewebdar T Tadesse
(74) *Attorney, Agent, or Firm* — Andrew C. Cheng

(57) ABSTRACT

The disclosure is related to a coating device comprising a syringe, an injection needle and a first cooling device. The injection needle is connected with the syringe, and the bottom end of the injection needle has a nozzle. The first cooling device is disposed on the outer wall of the syringe. According to the disclosure, the cooling device is disposed on the outer wall of the syringe and/or the injection needle, such that the problem of hardening of the liquid inside the syringe and/or the injection needle and cannot be ejected successfully can be avoided.

3 Claims, 2 Drawing Sheets

(56) References Cited

FOREIGN PATENT DOCUMENTS

| | | | | |
|---|---|---|---|---|
| CN | 204470009 | U | | 7/2015 |
| CN | PCT/CN2015/092719 | | | 3/2016 |
| JP | 2006-7126 | A | | 1/2006 |
| JP | 2006007126 | A | * | 1/2006 |
| JP | 2013056317 | A | * | 3/2013 |
| TW | 201018529 | A | | 5/2010 |
| WO | 2006018246 | A1 | | 2/2006 |

* cited by examiner

COATING DEVICE

TECHNICAL FIELD

The disclosure is related to a coating device, and more particularly, to a coating device having a cooling device.

RELATED ART

Organic light emitting display, i.e. OLED display is a novel display, and an organic thin film is formed on a substrate, wherein the organic thin film is sandwiched between a cathode metal and an anode metal. When a voltage is applied between the cathode metal and the anode metal, the organic thin film emits light. However, the organic thin film is sensitive to moisture and oxygen, such that it would be aged and denaturized due to moisture and oxygen, and the brightness and lifespan would be significantly decreased. Thus, a packaging process is necessary to the OLED devices. In general, sealant is coated to the surrounding of the glass, then the sealant is attached to the OLED substrate, and then is cured by UV such that a closed space is formed between the two glass and the sealant, and the organic thin film is disposed in the closed space.

In order to prevent the moisture, which permeates to the two glass, affect the lifespan of OLED devices, a liquid drying agent can be dropped to the inner side of the sealant, after the packaging process, a heating process of 80° C.~100° C. is performed, such that the liquid drying agent is solidified and becomes in solid phase, configured for absorbing the moisture which permeates to the two glass, and the lifespan of the OLED devices can be prolonged. In present technologies, the liquid drying agent is dropped by a coating device.

Regarding the thermal solidified liquid drying agents, they should be preserved under a low temperature (such as 0° C.~5° C.) and are liquid; when the temperature is raised to room temperature, they are liquid, such that the dropping process and be performed by a coating device, however, the thermal solidified liquid drying agents would be partly hardened under room temperature for a certain period of time, such that the materials in the coating device cannot be ejected and the process cannot be completed.

SUMMARY

In order to solve the above technical problem, one purpose of the disclosure is to provide a cooling device, comprising a syringe, an injection needle and a first cooling device, wherein the injection needle is connected with the syringe, the bottom end of the injection needle has a nozzle, and the first cooling device is disposed on the outer wall of the syringe.

Further, the first cooling device is a first cooling conduit, and the first cooling conduit surrounds the outer wall of the syringe.

Further, the first cooling conduit comprises a first pipe, a first coolant inlet end and a first coolant outlet end, the first coolant inlet end and the first coolant outlet end are disposed at the opposite ends of the first pipe, wherein the first coolant inlet end is disposed at the top of the outer wall of the syringe, and the first coolant outlet end is disposed at the bottom of the outer wall of the syringe.

Further, wherein the coating device further comprises a second cooling device disposed on the outer wall of the injection needle.

Further, the second cooling device is a second cooling conduit, and the second cooling conduit surrounds the outer wall of the injection needle.

Further, the second cooling conduit comprises a second pipe, a second coolant inlet end and a second coolant outlet end, the second coolant inlet end and the second coolant outlet end are disposed at the opposite ends of the second pipe, wherein the second coolant inlet end is disposed at the top of the outer wall of the injection needle, and the second coolant outlet end is disposed at the bottom of the outer wall of the injection needle.

Advantages of the disclosure: according to the disclosure, the cooling device is disposed on the outer wall of the syringe and/or the injection needle, such that the problem of hardening of the liquid inside the syringe and/or the injection needle and cannot be ejected successfully can be avoided.

BRIEF DESCRIPTION OF THE DRAWINGS

In order to more clearly illustrate the embodiments of the disclosure, the accompanying drawings for illustrating the technical solutions and the technical solutions of the disclosure are briefly described as below.

DETAILED DESCRIPTION

The following description with reference to the accompanying drawings is provided to clearly and completely explain the exemplary embodiments of the disclosure. It is apparent that the following embodiments are merely some embodiments of the disclosure rather than all embodiments of the disclosure. According to the embodiments in the disclosure, all the other embodiments attainable by those skilled in the art without creative endeavor belong to the protection scope of the disclosure. It can be realized that the terms "first" and "second" are configured for describing each elements, and the elements are not limited by the terms. These terms merely distinguish the elements.

Figure 1:
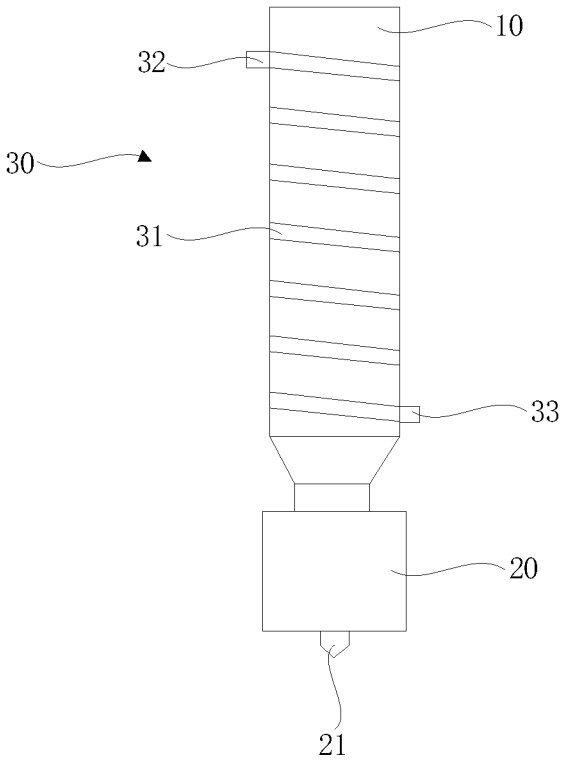
FIG. 1 is a schematic view of the coating device according to the first embodiment the disclosure.

FIG. 1 is a schematic view of the coating device according to the first embodiment the disclosure.

Referring FIG. 1, according to the first embodiment the disclosure, the coating device comprises: a syringe 10, an injection needle 20 and a first cooling device 30.

Specifically, the injection needle 20 is connected with the syringe 10, such that liquid (such as liquid drying agents) can be ejected to the injection needle 20 through the syringe 10; the bottom end of the injection needle 20 has a nozzle 21, such that the liquid entering the injection needle 20 can be ejected from the nozzle 21; the first cooling device 30 is disposed on the outer wall of the syringe 10 for cooling the liquid in the syringe 10.

Further, the first cooling device 30 is a first cooling conduit, and the first cooling conduit 30 surrounds the outer wall of the syringe 10. In general, a coolant is disposed inside the first cooling conduit 30, and the coolant is circulated in a controlled temperature of 0~5° C., so as to ensure that the liquid in the syringe 10 is treated under a low temperature.

Specifically, the first cooling conduit 30 comprises a first pipe 31, a first coolant inlet end 32 and a first coolant outlet end 33, the first coolant inlet end 32 and the first coolant outlet end 33 are disposed at the opposite ends of the first pipe 31, wherein the first coolant inlet end 32 is disposed at the top of the outer wall of the syringe 10, and the first coolant outlet end 33 is disposed at the bottom of the outer wall of the syringe 10. The coolant enters from the first coolant inlet end 32, flows to the first coolant outlet end 33 through the first pipe 31 and leaves by the first coolant outlet end 33.

It should be noticed that the first cooling conduit 30 in the disclosure is not limited to the cooling conduit shown in FIG. 1, and it can be other suitable cooling devices which can control the temperature.

Figure 2:
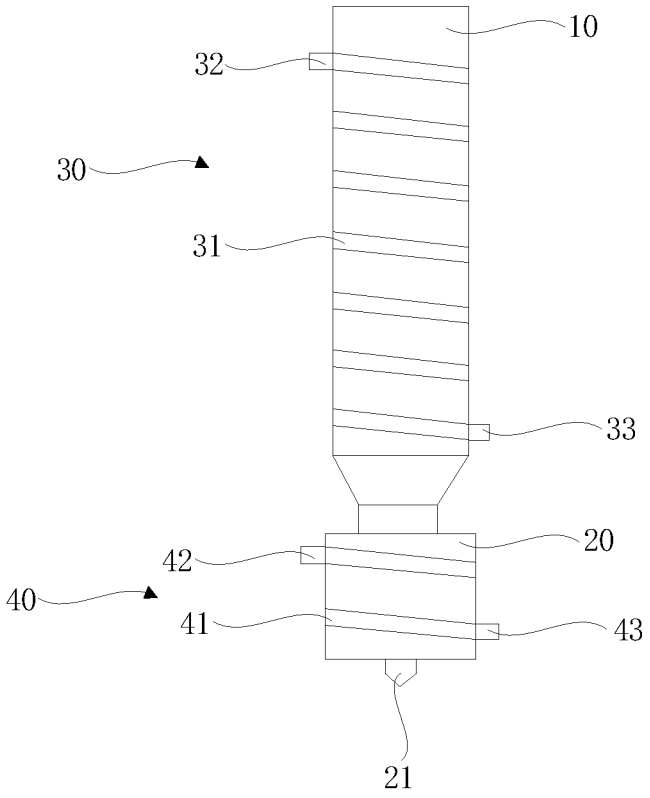
FIG. 2 is a schematic view of the coating device according to the second embodiment the disclosure.

FIG. 2 is a schematic view of the coating device according to the second embodiment the disclosure.

Referring FIG. 2, according to the second embodiment the disclosure, the coating device comprises: a syringe 10, an injection needle 20, a first cooling device 30 and a second cooling device 40.

Specifically, the injection needle 20 is connected with the syringe 10, such that liquid (such as liquid drying agents) can be ejected to the injection needle 20 through the syringe 10; the bottom end of the injection needle 20 has a nozzle 21, such that the liquid entering the injection needle 20 can be ejected from the nozzle 21; the first cooling device 30 is disposed on the outer wall of the syringe 10 for cooling the liquid in the syringe 10; the second cooling device 40 is disposed on the outer wall of the injection needle 20 for cooling the liquid in the s injection needle 20.

Further, the first cooling device 30 is a first cooling conduit, and the first cooling conduit 30 surrounds the outer wall of the syringe 10. In general, a coolant is disposed inside the first cooling conduit 30, and the coolant is circulated in a controlled temperature of 0~5° C., so as to ensure that the liquid in the syringe 10 is treated under a low temperature.

Specifically, the first cooling conduit 30 comprises a first pipe 31, a first coolant inlet end 32 and a first coolant outlet end 33, the first coolant inlet end 32 and the first coolant outlet end 33 are disposed at the opposite ends of the first pipe 31, wherein the first coolant inlet end 32 is disposed at the top of the outer wall of the syringe 10, and the first coolant outlet end 33 is disposed at the bottom of the outer wall of the syringe 10. The coolant enters from the first coolant inlet end 32, flows to the first coolant outlet end 33 through the first pipe 31 and leaves by the first coolant outlet end 33.

In addition, the second cooling device 40 is a second cooling conduit, and the second cooling conduit 40 surrounds the outer wall of the injection needle 20. In general, a coolant is disposed inside the second cooling conduit 40, and the coolant is circulated in a controlled temperature of 0~5° C., so as to ensure that the liquid in the injection needle 20 is treated under a low temperature.

Specifically, the second cooling conduit 40 comprises a second pipe 41, a second coolant inlet end 42 and a second coolant outlet end 43, the second coolant inlet end 42 and the second coolant outlet end 43 are disposed at the opposite ends of the second pipe 41, wherein the second coolant inlet end 42 is disposed at the top of the outer wall of the injection needle 20, and the second coolant outlet end 43 is disposed at the bottom of the outer wall of the injection needle 20. The coolant enters from the second coolant inlet end 42, flows to the second coolant outlet end 43 through the second pipe 41 and leaves by the second coolant outlet end 43.

It should be noticed that the first cooling conduit 30 and the second cooling conduit 40 in the disclosure are not limited to the cooling conduit shown in FIG. 2, and they can be other suitable cooling devices which can control the temperature.

According to the above description, the coating devices in the first embodiment and the second embodiment of the disclosure, the cooling device is disposed on the outer wall of the syringe and/or the injection needle, such that the problem of hardening of the liquid inside the syringe and/or the injection needle and cannot be ejected successfully can be avoided.

Note that the specifications relating to the above embodiments should be construed as exemplary rather than as limitative of the present disclosure. The equivalent variations and modifications on the structures or the process by reference to the specification and the drawings of the disclosure, or application to the other relevant technology fields directly or indirectly should be construed similarly as falling within the protection scope of the disclosure.

What is claimed is:

1. A coating device, comprising:

a syringe;

an injection needle, connected with the syringe, the bottom end of the injection needle having a nozzle;

a first cooling device, disposed on the outer wall of the syringe;

a second cooling device, which is a second cooling conduit, being disposed on the outer wall of the injection needle and surrounding the outer wall of the injection needle; and wherein the second cooling conduit further comprises a second pipe, a second coolant inlet end and a second coolant outlet end, the second coolant inlet end and the second coolant outlet end are disposed at the opposite ends of the second pipe, wherein the second coolant inlet end is disposed at the top of the outer wall of the injection needle, and the second coolant outlet end is disposed at the bottom of the outer wall of the injection needle.

2. The coating device according to claim 1, wherein the first cooling device is a first cooling conduit, and the first cooling conduit surrounds the outer wall of the syringe.

3. The coating device according to claim 2, wherein the first cooling conduit comprises a first pipe, a first coolant inlet end and a first coolant outlet end, the first coolant inlet end and the first coolant outlet end are disposed at the opposite ends of the first pipe, wherein the first coolant inlet end is disposed at the top of the outer wall of the syringe, and the first coolant outlet end is disposed at the bottom of the outer wall of the syringe.

* * * * *